United States Patent [19]

Datsenko

[11] 4,203,832

[45] May 20, 1980

[54] DEVICE FOR SEPARATING HEAVIER IMPURITIES FROM SOLID BODIES IN FLUID FLOW

[76] Inventor: Nikolai M. Datsenko, ulitsa Frunze, 131, kv. 16, Kiev, U.S.S.R.

[21] Appl. No.: 942,487

[22] Filed: Sep. 15, 1978

[51] Int. Cl.[2] ..... B03B 7/00

[52] U.S. Cl. ..... 209/44; 209/239; 209/452

[58] Field of Search ..... 209/17, 44, 293, 450, 209/451, 452

[56] References Cited

U.S. PATENT DOCUMENTS 1,450,515 4/1923 Richardson ..... 209/451

FOREIGN PATENT DOCUMENTS 13725 of 1895 United Kingdom ..... 209/44

*Primary Examiner*—Tim R. Miles

*Attorney, Agent, or Firm*—Lackenbach, Lilling & Siegel

[57] ABSTRACT

A device for separating heavier inpurities from solid bodies in a fluid flow comprising a trough-like casing accommodating a horizontal rotatable drum with a screen cylindrical side wall and groove-like elements move the impurities in the rotating drum towards an appliance intended to separate, receive and unload the impurities. The appliance is secured to the drum at the inlet for the fluid and the elements for moving the impurities are made as grooves arranged spirally in the side wall of the drum throughout its length. Each groove has a cylindrical side wall whose external surface protrudes beyond the external surface of the side wall of the drum, and two face walls are arranged perpendicularly to the cylindrical side wall. The external surface of one face wall directed towards the separating, receiving and unloading appliance serves for moving smaller impurities falling out of the screen side wall of the drum towards the appliance while the internal surfaces of the grooves serves for moving larger impurities towards the appliance. The device ensures a reduction of hydraulic resistance to the flow of fluid and also increases the efficiency of separation of impurities.

8 Claims, 3 Drawing Figures

DEVICE FOR SEPARATING HEAVIER IMPURITIES FROM SOLID BODIES IN FLUID FLOW

BACKGROUND OF THE INVENTION

The present invention relates to cleaning devices and, more particularly, to devices for separating heavier impurities from solid bodies in a fluid flow.

The devices for separating heavier impurities from solid bodies in a fluid flow will render most efficient service for separating heavier impurities from roots and tubers, such as beets and potatoes in beet-sugar, potato-starch making industries, and in beet and potato alcohol production.

The present invention can be utilized in agriculture for cleaning roots and tubers in the forage making, in canning industry, in public catering with centralized cleaning of roots and tubers and in other branches of industry where there is a need for separating impurities which are heavier than the main lump material conveyed by a fluid flow.

At present, with the rapid development of mechanization in harvesting root and tuber crops there is an evergrowing demand for highly efficient and economical devices for cleaning the roots and tubers from foreign matter, such as stones and sand.

Widely known in the prior art is a device for separating heavier impurities from solid bodies in a fluid flow. This device comprises a screen drum mounted horizontally in a casing and it is secured by struts on a shaft.

The casing of the device is fastened to a hydraulic conveyor, has a trough-like shape and is formed by a part of a stepped cylinder.

Spirally-arranged ribs are secured to the external and internal surfaces of the screen drum.

The ribs fastened to the internal surface of the drum are intended to move the larger impurities settling in the drum against the flow of fluid delivered by the hydraulic conveyor. The ribs secured to the external wall of the drum catch the impurities which fall out through holes in the screen side wall of the drum and move them over the internal surface of the casing.

Fastened to the drum face at the inlet of the fluid delivered by the hydraulic conveyor and carrying solid bodies and impurities is an appliance arranged coaxially with said drum and designed to separate, receive and unload the impurities.

The basic disadvantage of the known device for separating heavier impurities from solid bodies in a fluid flow is in that the efficiency of separation by the device drops sharply with an increase in the quantity of the solid bodies carried by the fluid flow.

This is attributable to the fact that the ribs secured to the internal surface of the screen drum and protruding above said surface offer an additional resistance to the flow of fluid carrying the solid bodies and thus reduce the velocity of the flow and cause the solid bodies carried by the fluid to settle in the drum. This, in turn, hinders the conveyance of larger impurities by the internal ribs to the applicance for separating, receiving and unloading the impurities. The impurities that have settled in the drum during its rotation are gradually moved along the flow together with the solid bodies which reduces considerably the efficiency of the device.

Another no less important disadvantage of the prior art device lies in that the concentration of the solid bodies in the flow of fluid moving inside the drum becomes higher.

This is attributable to the fact that part of the fluid carrying the solid bodies to be cleaned passes beyond the drum through the gaps between the external ribs of the drum and the casing.

The resistance to the movement of such a flow in the drum grows, thus increasingly reducing the efficiency of the device.

SUMMARY OF THE INVENTION

The main object of the present invention resides in providing a device for separating heavier impurities from solid bodies in a fluid flow, wherein the elements intended to convey the impurities would offer a minimum resistance to the fluid flow and, consequently, ensure a generally high efficiency of the device.

Another no less important object of the present invention resides in providing a device for separating heavier impurities from solid bodies in a fluid flow, wherein the elements intended to convey the impurities would be designed so that the amount of fluid passing through the gaps between the ribs and the casing would diminish, thus keeping the concentration of solid bodies in the fluid flow practically unchanged.

These and other objects of the invention are accomplished by providing a device for separating heavier impurities from solid bodies in a fluid flow whose trough-like casing accommodates a horizontal rotatable drum with a screen side wall and with elements for moving the impurities in the rotating drum towards an appliance designed to separate, receive and unload impurities. The appliance is fastened to the drum at the inlet of the fluid flow which carries the solid bodies and foreign matter. The elements for moving the impurities are made in the form of grooves arranged spirally throughout the length of the side wall of the drum. Each element has a cylindrical side wall whose external surface protrudes from the external surface of the screened side wall of the drum, and two face walls are arranged essentially perpendicularly to its cylindrical side wall. The external surface of one of said face walls facing the appliance serves for moving smaller impurities falling out of the screened side wall of the drum towards the appliance while the inner surfaces of the grooves serves for displacing larger impurities towards the appliance.

This design of the elements which force the impurities towards the appliance for separating, receiving and unloading impurities ensures a reduction of the resistance to the flow of fluid carrying the impurities and the solid bodies. This raises the efficiency of separation of impurities by the device which becomes particularly conspicuous in the case of a larger quantity of solid bodies entering the device with the fluid flow.

It is practicable that the face wall of each groove facing the appliance should protrude beyond the external surface of its cylindrical side wall.

This embodiment of the face walls of the grooves is very reliable and provides for the unrestricted movement of the impurities falling out through the holes in the screened side wall of the drum and their moving further over the internal wall of the casing towards the appliance for separating, receiving and unloading the impurities.

The impurities remaining on the inside wall of the casing after passing the face wall do not reach the cylindrical side wall which thus aids in preventing the jamming of the drum.

It is practicable that the longitudinal axis of the grooves should be eccentric relative to the longitudinal axis of the casing so that the gaps between the groove walls and the casing increase in the direction of drum rotation.

This prevents jamming of the drum in the casing of the device and, as a consequence, reduces the dynamic loads on the drive and raises the operational reliability of the device.

It is practicable that the width of the cylindrical side wall of each groove increase gradually lengthwise towards the appliance.

The variable width of the cylindrical side walls of the grooves accounts for the variable cross section of the grooves in width which preclude jamming of foreign matter and solid bodies in the grooves.

Due to this fact the foreign matter and the solid bodies in the grooves move freely during rotation of the drum towards the appliance for separating, receiving and unloading the foreign matter.

It is also advantageous that the cylindrical side walls of the grooves are provided with holes.

These holes improve circulation of liquid and are conducive to better separation of the small impurities from solid bodies.

The novel device for separating heavier impurities from solid bodies in a fluid flow offers a considerably lower resistance to the flow of fluid carrying solid bodies which steps up the efficiency of separation even in case of a relatively large quantity of solid bodies entering the device with the fluid flow.

The device is sufficiently reliable in operation, comparatively simple to manufacture and does not call for skilled operators. It can be installed on the aboveground and underground sections of the hydraulic conveyor without occupying production floor areas.

BRIEF DESCRIPTION OF THE DRAWINGS

Now the invention will be described in detail by way of example with reference to the accompanying drawings in which.

DESCRIPTION OF THE PREFERRED EMBODIMENTS

Figure 1:
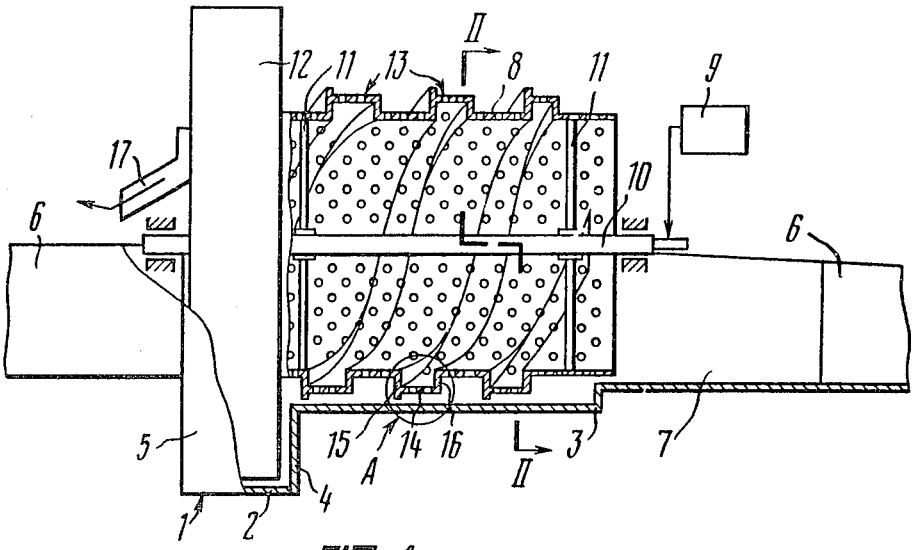
FIG. 1 is a partial longitudinal sectional view of the device for separating heavier impurities from solid bodies in a fluid flow.

The device for separating heavier impurities from solid bodies in a fluid flow comprises a casing 1 (FIG. 1) of a trough-like shape which changes along the length of the casing from a large-diameter half-cylinder 2 to a small-diameter half-cylinder 3, both being interconnected by a semicircular wall 4.

At the entrance of the flow the casing 1 is limited by a flat circular wall 5 and joins directly the hydraulic conveyor 6.

At the exit side of the flow the casing 1 has a narrowing portion 7 adjoining the hydraulic conveyor 6.

Installed horizontally in the casing 1 is a drum 8 with a cylindrical screen or perforated side wall, designated by the same numeral 8 and rotated by a drive 9 of any conventional design suitable for the purpose.

The drum 8 is mounted on a shaft 10 with the aid of struts 11.

An appliance 12 is secured to the drum 8 and is intended for separating, receiving and unloading impurities. This appliance 12 is also accommodated in the casing 1 and it is arranged coaxially with the drum 8 at the point where it receives the flow of fluid carrying dirty solid bodies (in this case muddy roots and tubers). The fluid is delivered by the hydraulic conveyor 6. The appliance 12 may be of any design suitable for the purpose and is not dealt with here in order not to obscure the substance of the invention.

The screen wall of the drum 8 has elements 13 intended to move the impurities from the drum 8 to the appliance 12; said elements have the form of grooves and are designated by the same number 13.

The grooves 13 run spirally throughout the length of the cylindrical screen side wall of the drum 8.

The external side wall 14 (FIGS. 1, 2) of each groove 13 protrudes beyond the external surface of the side wall of the drum 8.

Each groove 13 has two face walls 15 and 16 arranged approximately perpendicular to its cylindrical side wall 14. Therefore, the section of each groove 13 taken across the longitudinal axis of the drum 8 is rectangular, open at the inner side of the drum 8.

The external surface of the face wall 15 directed towards the appliance 12 serves for moving small impurities, falling out of the screen side wall of the drum 8 over the internal surface of the casing 1, towards the appliance 12.

The internal surfaces of the grooves 13 convey the heavier impurities settled in the drum 8 towards the appliance 12.

Figure 3:
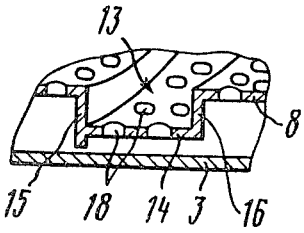
FIG. 3 is an enlarged fragmentary view of the zone or area A, shown in FIG. 1.

In each groove 13, the face wall 15 directed towards the appliance 12 protrudes somewhat beyond the external surface of the side wall 14 of said groove as best shown in FIG. 3.

This ensures reliable and unrestricted movement of the impurities falling out through the screen side wall of the drum 8 over the internal wall of the casing 1 towards the appliance 12 for separating, receiving and unloading the impurities.

The longitudinal axis of the grooves 13 is arranged with an eccentricity "e" (FIG. 2) relative to the longitudinal axis of the casing 1.

As a result, the gaps between the walls 15 and 14 and the casing 1 of the device increase in the direction of rotation of the drum 8 which preclude its jamming when small impurities move over and along the internal surface of the casing 1. The drum 8 is rotated by the drive 9 clockwise, viewing the drum 8 from the side of the appliance 12.

Figure 2:
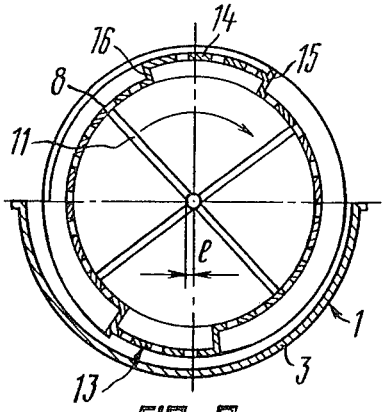
FIG. 2 is a cross-sectional view taken along line II—II in FIG. 1.

The width of the cylindrical side wall 14 of each groove 13 increases gradually lengthwise towards the appliance 12 as shown in FIG. 1.

With such an arrangement, neither impurities nor roots and tubers can be jammed in the grooves 13, and during rotation of the drum 8 they move freely towards the appliance 12.

Installed in the upper part of the appliance 12 is a chute 17 fastened to the casing 1 and it receives the impurities unloaded from the appliance 12.

The cylindrical side walls 14 of the grooves 13 have holes 18 (FIG. 3) to improve circulation of liquid and separation of smaller impurities such as, say, sand. In other cases, such holes may also be provided in the face wall 15 if desired.

The device for separating heavier impurities from solid bodies in a fluid flow functions as follows.

The flow of fluid carrying solid bodies (in this case roots and tubers) and impurities is moved by the hydraulic conveyor 6 into the device. Larger impurities move over the bottom of the hydraulic conveyor 6 and enter the appliance 12 where they are separated from the roots and tubers in the rotating drum with the aid of a rising fluid flow created in said appliance 12 and such larger impurities are then discharged into the chute 17.

The rising flow of fluid is part of the fluid directed from underneath upward at a velocity which prevents the roots and tubers from settling together with the impurities.

A certain proportion of the impurities does not settle in the appliance 12 and is thrown out of it by the rising flow of fluid together with the roots and tubers and settles in the screen drum 8, where the cross sectional area of the flow sharply increases as compared with the cross section of the hydraulic conveyor 6, whereby the velocity of the flow is reduced.

The larger impurities move down inside the drum 8 into the grooves 13 while the smaller impurities pass through the holes in the screen side wall of the drum 8 and through the holes 18 in the cylindrical side walls 14 of the grooves 13 and descend into the casing 1.

Due to the spiral arrangement of the grooves 13, the larger impurities are moved in the rotating drum 8 inside the grooves 13 with the aid of the face walls 16 towards the appliance 12 where they are entrained by the rising fluid flow for separation from the roots and tubers.

The smaller impurities that fall into the casing 1 over the inside surface of the smaller-diameter half-cylinder 3 are moved by the face walls 15 of the grooves 13 towards the flaring-out part of the casing 1 formed by the large diameter half-cylinder 2. Then the smaller impurities are taken from this part of the casing 1 by the appliance 12 together with a certain amount of fluid and, moving past the rising flow, are unloaded and deposited onto the chute 17 together with the larger impurities.

The roots and tubers continue their movement in the fluid flow through the drum 8 and further, through the narrowing port 7 of the casing 1, to the hydraulic conveyor 6.

The experimental specimens of the device for separating heavier impurities from solid bodies in a fluid flow realized according to the present invention have passed comprehensive tests. The results of these tests have proved a comparatively high efficiency of the device, particularly with a considerably large proportion of solid bodies in the fluid flow.

The novel device is reliable and simple in manufacture.

While a specific embodiment of the invention has been disclosed in the description, it will be understood that various modifications and changes within the scope of the invention may occur to those skilled in the art.

These changes and modifications can be resorted to without departing from the function or the scope of the device which has been disclosed exclusively as a non-confining example.

What we claim is:

1. A separating and cleaning device having inlet and exit sides for separating heavier impurities from solid bodies, such as roots and tubers or the like conveyed by a fluid flow supply source comprising: a trough-like casing for receiving said fluid from said supply source; a hollow drum having a cylindrical perforated side wall being disposed substantially horizontally and coaxially in said trough-like casing and being supported on a rotatable shaft; an appliance for separating, receiving and unloading impurities disposed in said trough-like casing and being secured to said drum at the inlet side of said device; elements in said drum for moving said impurities towards said appliance in the form of grooves arranged spirally in the side wall of said drum throughout its length; each said groove having a cylindrical side wall and two face walls arranged substantially perpendicularly to said cylindrical perforated side wall of said drum; the cylindrical side wall of each groove protrudes beyond the perforated side wall of said drum, the face walls of said grooves nearest said appliance serve for moving towards said appliance sand or other relatively small impurities falling out from the perforated side wall of said drum, and the internal surfaces of each groove serve for moving toward said appliance stones or other relatively large impurities which have settled in said drum; and the roots and tubers being carried by said fluid through said drum to the exit of said device.

2. A device according to claim 1 wherein the longitudinal axis of the grooves is eccentric relative to the longitudinal axis of said casing so that the gaps between the cylindrical side walls of said grooves and said casing increase in the direction of rotation of said drum.

3. A device according to claim 1 wherein the width of the cylindrical perforated side wall of each groove gradually increases lengthwise towards said appliance.

4. A device according to claim 1 wherein the cylindrical side wall of each groove is provided with holes.

5. A device according to claim 1, including a drive for rotating said shaft and said drum.

6. A device according to claim 1, wherein said appliance is of a larger diameter than said drum, and said casing having a trough-like shape with a large diameter half-cylinder accomodating said appliance and a smaller diameter half-cylinder accomodating said drum and said half cylinders being interconnected to form a unitary trough-like casing.

7. A device according to claim 1 wherein the face wall of each groove directed nearest said appliance protrudes beyond the external surface of the cylindrical side wall of said groove.

8. A device according to claim 2, wherein the other of said two face walls is provided with apertures.

* * * * *